US006186638B1

(12) United States Patent
Chang

(10) Patent No.: US 6,186,638 B1
(45) Date of Patent: Feb. 13, 2001

(54) WRENCH WHICH INCLUDES FLASHLIGHT

(75) Inventor: Kao-Huo Chang, Taichug (TW)

(73) Assignee: AWI Acquisition Company, Sylmar, CA (US)

( * ) Notice: Under 35 U.S.C. 154(b), the term of this patent shall be extended for 0 days.

(21) Appl. No.: 09/411,298

(22) Filed: Oct. 4, 1999

(51) Int. Cl.[7] ..... F21W 111/10; F21L 4/00
(52) U.S. Cl. ..... 362/119; 362/120; 362/197
(58) Field of Search ..... 362/197, 119, 362/120, 109

(56) References Cited

U.S. PATENT DOCUMENTS 1,309,363 * 7/1919 Meinke ..... 362/120
1,439,404 * 12/1922 Cotharin ..... 362/119
1,639,889 * 8/1927 Humm ..... 362/120
5,477,434 * 12/1995 Reed ..... 362/119
5,848,832 * 12/1998 Hsieh ..... 362/120 X
5,899,554 * 5/1999 Hsu ..... 362/119
6,106,133 * 8/2000 Lee ..... 362/120 X
6,116,746 * 9/2000 Hsu ..... 362/119
6,116,747 * 9/2000 Grawemeyer et al. ..... 362/120 X

* cited by examiner

*Primary Examiner*—Laura K. Tso
(74) *Attorney, Agent, or Firm*—Jack C. Munro

(57) ABSTRACT

A hand tool in the form of a wrench that has an operating head to which is attached an elongated handle. Mounted within the elongated handle is a flashlight with the light emitting head of the flashlight being pivotally adjustable so as to shine the emitted light to different positions so the light is directed to the operating area of the operating end of the wrench. The flashlight is removably mounted onto the handle of the wrench so as to permit the flashlight to be removed and used separately from the wrench.

6 Claims, 2 Drawing Sheets

WRENCH WHICH INCLUDES FLASHLIGHT

BACKGROUND OF THE INVENTION

1) Field of the Invention

This invention relates to hand tools and more particularly to a wrench type of hand tool which includes an illuminating device that is intended to illuminate the operating area to which the wrench is being applied.

2) Description of the Prior Art

Hand tools in the form of wrenches have long been known. The common form of wrenches is what is termed a ratchet wrench which is connectable to various types of drivers or sockets, the driver or socket of the wrench then to be applied to a fastener or a fastener nut for the purpose of tightening the fastener or fastener nut. Many times when the operating of these wrenches, the fastener or fastener nut that is being tightened is not only in an inaccessible location but is also in a darkened location. It is common in such locations for the user to operate by "feel" in obtaining of the connection between the wrench and the fastener or the fastener nut as opposed to using sight. In some instances, "feel" is even difficult and sight is an absolute requirement. In such instances, usually there is a second person involved that operates a flashlight to illuminate the area of operation so that a satisfactory job of tightening the fastener or fastener nut can be achieved.

SUMMARY OF THE INVENTION

A primary objective of the present invention is to construct a wrench within which is incorporated a flashlight with this flashlight to be used to illuminate the area that is being operated on by the wrench.

Another objective of the present invention is to construct a wrench which includes a flashlight where the light emitting head of the flashlight can be adjusted to different positions.

Another objective of the present invention is to construct a wrench which includes a flashlight as a separate structure with provision being mounted in conjunction with the wrench to permit detachment of the flashlight from the wrench permitting the flashlight to be used separately.

Another objective of the present invention is to construct a wrench which includes a flashlight which can be manufactured at a reasonable cost and thereby sold to the ultimate consumer at a reasonable cost.

Another objective of the present invention is to construct a wrench which can be used to illuminate darkened areas thereby eliminating the need for a second person to use a flashlight to illuminate the area of operation.

A wrench which has an operating end to which is attached an elongated handle. The elongated handle includes an elongated pocket. The handle also includes a through opening. The body of a flashlight is to be mounted within the pocket with the light emitting head of the flashlight connecting with the through opening. The light emitting head is adjustable to various positions relative to the body of the flashlight. The light emitting head is designed to emit light to the area of operation by the operating end. A movable latching cover is mounted on the handle and is designed to be located in a latching position which secures the flashlight to the handle or movable to a displaced position which will permit the flashlight to be removed from the handle.

DETAILED DESCRIPTION OF THE PREFERRED EMBODIMENT

Figure 1:
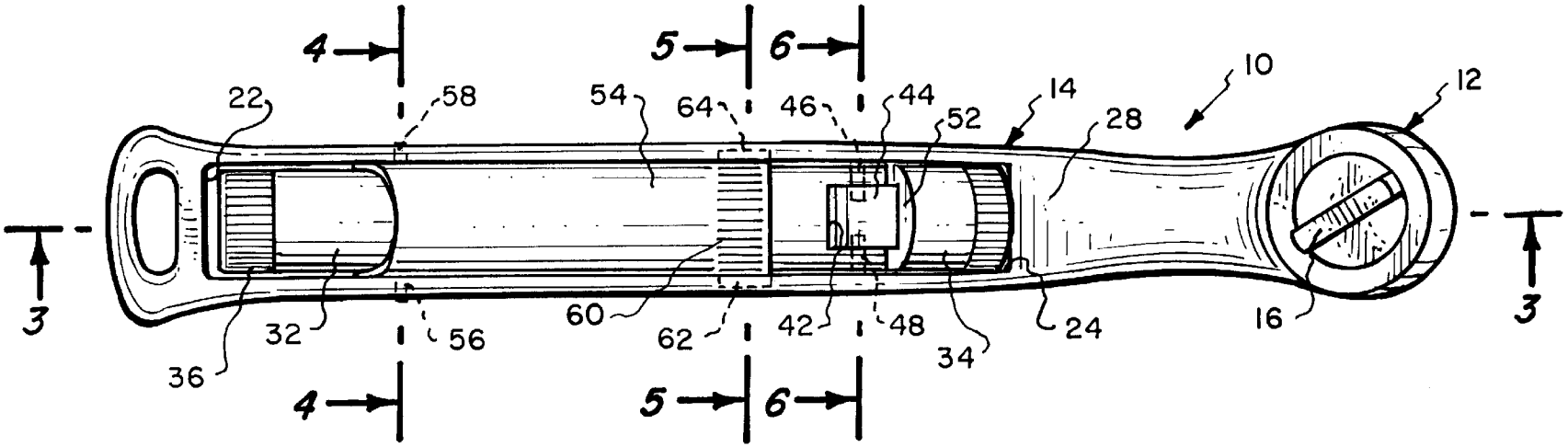
FIG. 1 is a top plan view of the wrench of the present invention.

Referring particularly to the drawings, there is shown the wrench 10 of this invention. The wrench 10 has an operating end 12 and a handle 14. The operating end 12 will normally include some form of a ratchet mechanism which is to be operated by pivotable lever 16 which is deemed to be conventional. However, it is not mandatory for the operating end to include the latching mechanism. Typically, the operating end 12 will include a polygonal-shaped protrusion 18 which is designed to connect with an extension rod, a driver or a socket 20. It is to be understood that the socket 20 or driver is to be used to connect to a fastener or fastener nut which is then to be tightened by usage of the wrench 10. The fastener or the fastener nut is not shown.

The operating end 12 is integrally connected to the handle 14. However, as far as this invention is concerned, it is immaterial whether the operating end 12 is integrally connected to the handle 14 and could comprise two separate parts which are interconnected together. The handle 14 includes an elongated pocket 22. The forward end of the pocket 22 connects with a through hole 24. The forward end of the through hole 24 includes a relieved portion 26. The through hole 24 connects between the upper side 28 and the lower side 30 of the handle 14.

Figure 3:
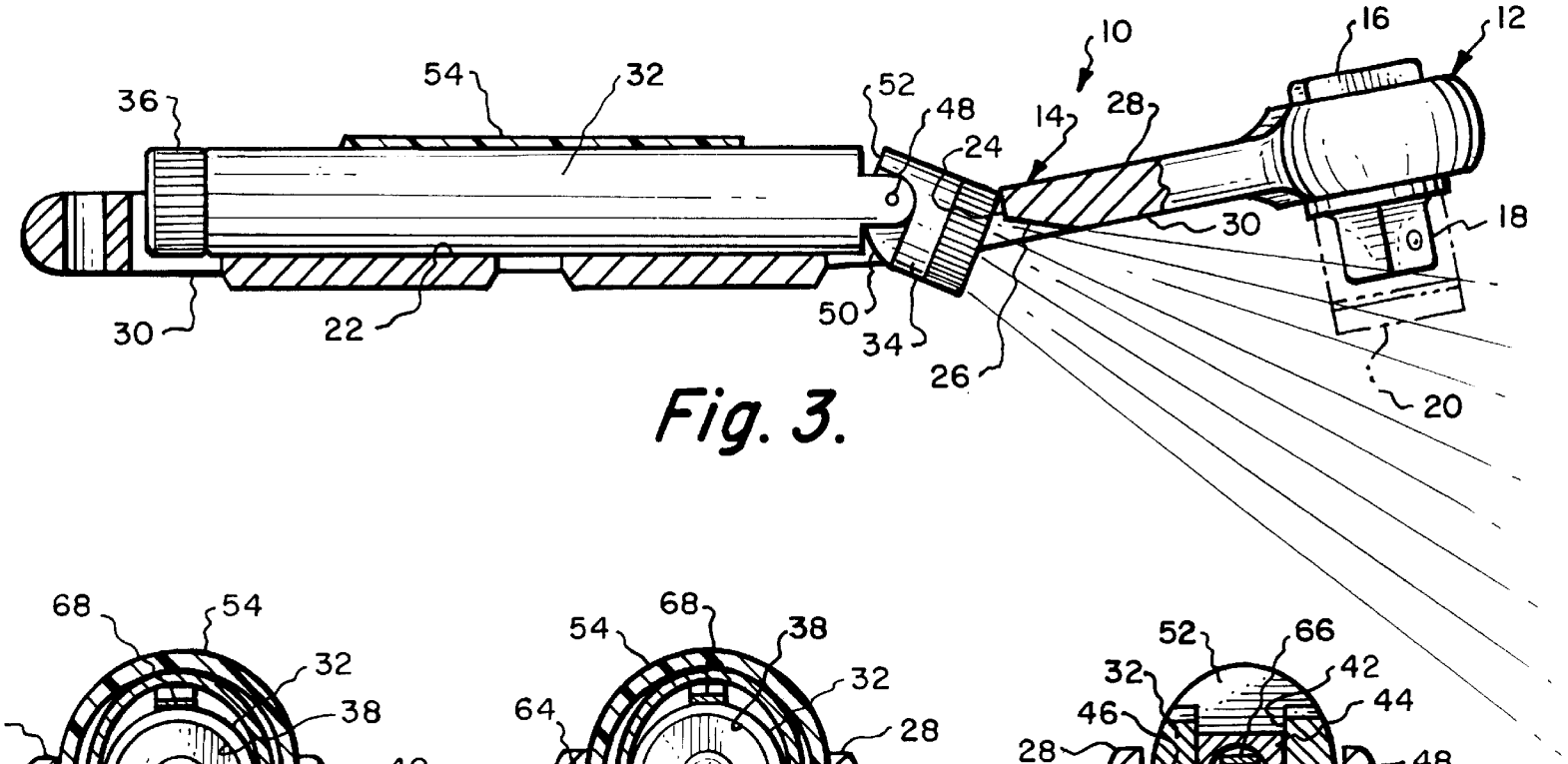
FIG. 3 is a longitudinal cross-sectional view of the wrench of the present invention taken along line 3—3 of FIG. 1.
Figure 6:
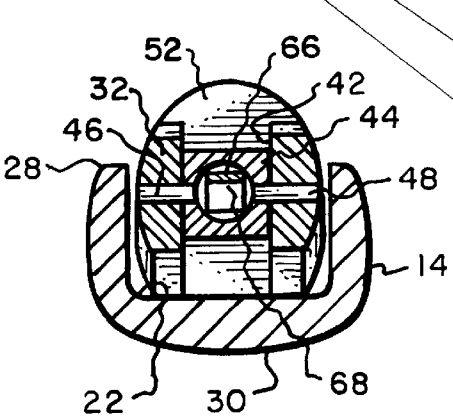
FIG. 6 is a transverse cross-sectional view taken through the handle of the wrench and the body of the flashlight taken along line 6—6 of FIG. 1.
Figure 5:
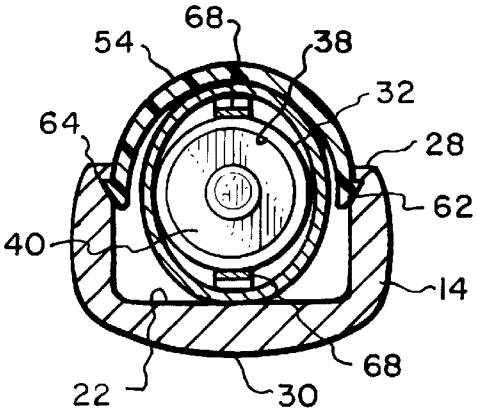
FIG. 5 is a transverse cross-sectional view taken through the handle of the wrench and the body of the flashlight taken along line 5—5 of FIG. 1.
Figure 4:
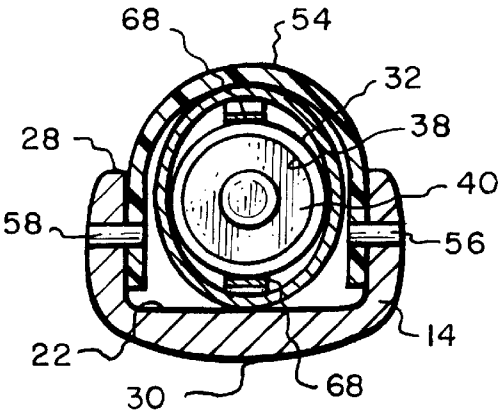
FIG. 4 is a transverse cross-sectional view taken through the handle of the wrench and the body of the flashlight taken along line 4—4 of FIG. 1.

A flashlight which has a flashlight body 32 and a light emitting head 34 is designed to be mountable within the pocket 22 with the light emitting head 34 connecting with the through hole 24. The rear end of the body 22 is closed by an end cap 36. The end cap 36 is intended to close battery compartment 38 of the body 32. Within the battery compartment 38 is to be located a plurality of conventional batteries 40. The forward end of the body 32 is bifurcated forming a center slot 42. The protrusion 44, which is integral with the light emitting head 34, is mounted within the center slot 42. Pins 46 and 48 are mounted within the bifurcated portion of the body 42 and are to connect with the protrusion 44 resulting in the light emitting head 34 being pivotally mounted relative to the body 32. The amount of pivotable movement of the light emitting head 34 is limited to about forty-five degrees. The light emitting head 34 can be adjusted at various angles in order to direct light either closer to the operating end 12 or a little bit further away from .The operating end 12. In other words, if the wrench 10 of this invention is being used with the socket 20, then the light emitting head 34 is located in the position of FIG. 3 to direct the light very near the operating end 12 and actually to illuminate the socket 20 and the adjacent area. The relief portion 26 is included so as to not block this illumination. However, if the operating end 12 is connected to a longer tool, such as an extension or a driver, which will mean that the operation on the fastener or fastener nut is at some short distance spaced slightly further from the operating end 12, the light emitting head 34 can be adjusted to illuminate that particular area with this adjusting being achieved by pivoting of the light emitting head 34 in a further clockwise direction from the position shown in FIG. 3. It is to be noted that the light emitting head 34 includes a rounded section 50 to facilitate this pivoting action. The light emitting head 34 also includes a right-angled wall 52 which is to abut against the body 32 when the light emitting head 34 is in substantial alignment with the body 32.

It is to be understood that the flashlight included within this invention can be removed from the pocket 22. In order to achieve this removal, there is utilized a latching cover 54 which is basically in the shape of a half circle and at one end thereof, is connected to pivot pins 56 and 58. The pivot pins 56 are mounted within the handle 14. The latching cover 54 has a forward end which has serrated sections 60 which facilitate manual grasping of the forward end of the latching cover 54. The forward end of the latching cover 54 also includes a pair of oppositely facing protrusions 62 and 64. The protrusions 62 and 64 are to connect with indentations formed within the handle 14.

Figure 2:
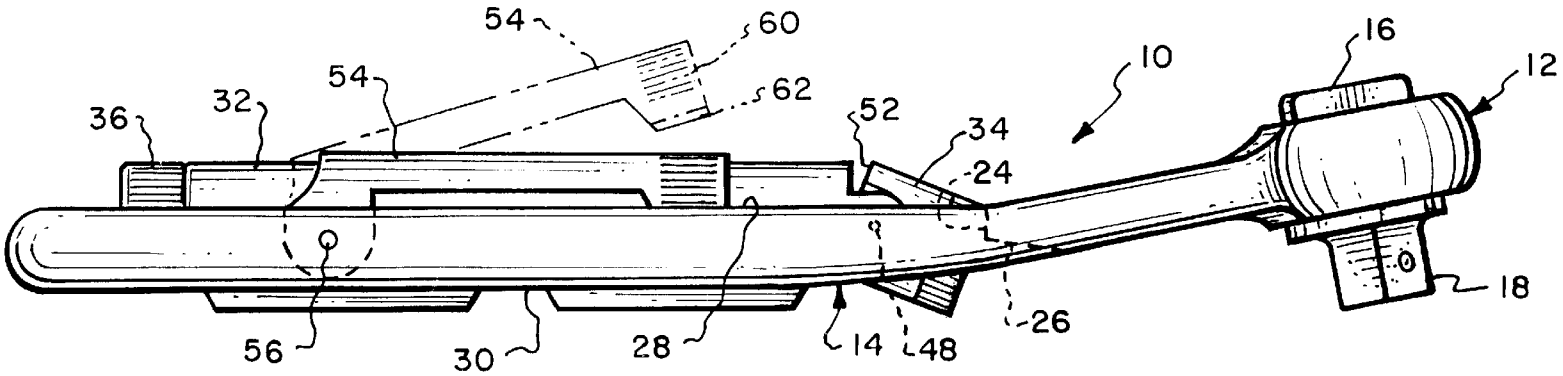
FIG. 2 is a side elevational view of the wrench of the present invention.

With the flashlight mounted within the pocket 22 and the latching cover 54 in the solid line position shown in FIG. 2, the flashlight is securely latched in position relative to the handle 14. However, upon manual grasping of the serrated section 60 and squeezing of such, the protrusions 62 and 64 will disengage from their respective indentations and permit the cover 54 to be pivoted to the dotted line position shown in FIG. 2. This will permit the flashlight, composed of the body 32 and light emitting head 34, to be disengaged from the pocket 22 with the flashlight to then be used independently of the wrench 10.

The protrusion 44 includes a through hole 66 through which is conducted electrical connector 68. This electrical connector 68 is to make the electrical connection between the batteries 40 and the lamp, which is not shown, and mounted within the light emitting head 34.

It is to be noted that the body 32 of the flashlight is intended to be mounted in only one position within the pocket 22. This position is so that the pivot axis of the light emitting head 34 is located parallel to the planes of the upper side 28 and the lower side 30 which are also located parallel to each other. The body 32 may be formed of a slight elliptical shape with only the narrow dimension of the body 32 permitting mounting of the body 32 in conjunction with the pocket 22 thereby insuring that the body 32 is correctly positioned within the pocket 22. If per chance the body 32 is installed in a reverse direction, which means that the light emitting head 34 would only be able to shine light in the area of lever 16, the user is then to physically pick up the flashlight and reverse same one hundred eighty degrees and reinstall such within the pocket 22.

What is claimed is:

1. In combination with a wrench having an operating end to which is mounted an elongated handle, the improvement comprising:

said handle having an upper side and a lower side;

mounting means connected to said upper side;

a through hole formed within said handle, said through hole connecting between said upper side and said lower side; and a flashlight having a body and a light emitting head, said flashlight comprising a separate structure from said wrench, said body connecting with said mounting means, latching means for fixing said body to said handle, said light emitting head connecting with said through hole so as to be able to shine light in a direction away from said lower side to an area located in alignment with said operating hand.

2. The combination as defined in claim 1 wherein:

said mounting means comprising a pocket.

3. The combination as defined in claim 1 wherein:

said flashlight being removably mounted to said body, whereby said flashlight is capable of being removed from said body and used independently of said wrench.

4. The combination as defined in claim 1 wherein:

said light emitting head being pivotally mounted on said body so said light emitting head can be adjusted to assume different angular positions relative to said body.

5. The combination as defined in claim 1 wherein:

said latching means comprising a cover, said cover being movably mounted on said body, said cover to be movable to a position to permit disengagement of said flashlight from said body.

6. The combination as defined in claim 5 wherein:

said cover being pivotally mounted relative on said handle to be movable from a latched position to a displaced position permitting removing and installing of said flashlight in conjunction with said handle.

* * * * *